US005109882A

United States Patent [19]

Eley

[11] Patent Number: 5,109,882

[45] Date of Patent: May 5, 1992

[54] HOSE REEL

[76] Inventor: John H. Eley, Box B, Orchard, Nebr. 68764

[21] Appl. No.: 659,516

[22] Filed: Feb. 21, 1991

[51] Int. Cl.[5] ..... B65H 75/34

[52] U.S. Cl. ..... 137/355.21; 137/355.27; 242/86.2

[58] Field of Search ..... 137/355.16, 355.19, 137/355.2, 355.21, 355.26, 355.27; 242/86, 86.2, 86.4, 86.5 R, 99; 248/76;.239/198

[56] References Cited

U.S. PATENT DOCUMENTS

| | | | |
|---|---|---|---|
| 2,219,201 | 10/1940 | Smith | 137/355.21 X |
| 2,823,074 | 2/1958 | Bernard, Jr. | 242/99 X |
| 4,655,399 | 4/1987 | Harvey | 242/86.2 X |
| 4,700,737 | 10/1987 | Nelson | 137/355.27 |
| 4,757,838 | 7/1988 | McGullion | 137/355.27 |
| 4,768,546 | 9/1988 | Brusadin et al. | 137/355.27 |
| 4,974,627 | 12/1990 | Nelson | 137/355.2 X |

FOREIGN PATENT DOCUMENTS

| | | | |
|---|---|---|---|
| 384787 | 12/1932 | United Kingdom | 137/355.26 |

*Primary Examiner*—Martin P. Schwadron
*Assistant Examiner*—Kevin L. Lee
*Attorney, Agent, or Firm*—Zarley, McKee, Thomte Voorhees & Sease

[57] ABSTRACT

A hose reel includes a reel member rotatably mounted on a horizontal portion of an upstanding tube. The upstanding tube extends vertically from the horizontal portion and thence diagonally, to a lower vertical portion aligned generally under the center of the reel member. The lower end of the upstanding tube is rotatably mounted to one end of a support arm so that the reel and upstanding tube member combination will rotate around a vertical axis. The support arm extends a distance permitting complete rotation of the reel and upstanding tube, and has a short depending arm which is slidably mounted within a tubular support. A flexible hose is inserted through the upstanding tube, and has a swivel valve connected to the lower end thereof and a second swivel valve connected to the upper end thereof, to supply fluid to a hose on the reel while permitting full rotation of the reel member as well as rotation of the upstanding tube on the support arm. A generally U-shaped rod member extends parallel to the reel hub and has its legs rotatably connected to the horizontal portion of the upstanding tube so as to rotate around the longitudinal axis of the hub, to act as a hose guide.

17 Claims, 9 Drawing Sheets

HOSE REEL

TECHNICAL FIELD

The present invention relates generally to hose reels, and more particularly to a hose reel which is rotatably and pivotally mounted so as to permit free rotation for uncoiling hose, and free pivoting through 360° to permit free extension of the hose in any direction.

BACKGROUND OF THE INVENTION

Various types of hose reels have been known for a long period of time. In the field of high pressure washers, a hose reel is utilized to permit the extension and retraction of a spray nozzle from the washer unit.

One problem with prior art hose reels for pressure washers was in their limitation on the direction in which the hose could be retracted. Typically, the hose could only be retracted forwardly from the reel, thereby requiring the user to move the entire washer in order to retract the hose from a rearward direction. Furthermore, while hose guides have been utilized in various types of reels, they were typically fixed, thereby limiting the direction in which the hose could be extended or retracted on the hose reel.

Yet another problem with prior hose reels is in their method of mounting on or adjacent to the high pressure washer. In most cases, the reel is permanently mounted to the washer, or affixed in a fashion which prevented quick and easy removal. Thus, it was necessary to utilize separate and additional hose reels for each various task.

Furthermore, on prior art hose reels, it was difficult to rewind the hose uniformly on the reel. Unless the hose was "layered" appropriately on the reel, the capacity of the reel suffered greatly.

It is therefore a general object of the present invention to provide an improved hose reel.

Another object of the present invention is to provide an improved hose reel which is rotatable to extend or retract hose, and pivotal through 360° to permit hose extension in any direction.

A further object is to provide an improved hose reel with a selectively movable hose guide to permit retraction of a hose on to the reel from a forward or rearward direction.

Still another object of the present invention is to provide an improved hose reel which will "layer" the hose uniformly on the reel.

Yet another object is to provide a support bracket for a hose reel which permits quick and easy mounting and dismounting of a hose reel.

These and other objects will be apparent to those skilled in the art.

SUMMARY OF THE INVENTION

The hose reel of the present invention includes a reel member rotatably mounted on a horizontal portion of an upstanding tube, the reel member having a pair of annular flanges projecting outwardly from a hub to form an annular channel for receiving a hose thereon. The upstanding tube extends vertically from the horizontal portion and is bent around one of the annular flanges and extends downwardly to a lower vertical portion aligned generally under the center of the reel member. The lower end of the upstanding tube is rotatably mounted to one end of a support arm so that the entire reel and upstanding tube member will rotate around a vertical axis. The support arm extends a distance permitting complete rotation of the reel and upstanding tube, and has a short depending arm which is slidably mounted within a tubular support. A flexible hose is inserted through the upstanding tube, and has a swivel valve connected to the lower end thereof and a second swivel valve connected to the upper end thereof, to supply fluid to a hose on the reel while permitting full rotation of the reel member as well as rotation of the upstanding tube on the support arm. A generally U-shaped rod member extends parallel to the reel hub and has its legs rotatably connected to the horizontal portion of the upstanding tube so as to rotate around the longitudinal axis of the hub. The hose on the reel is threaded through the hose guide to assist in layering the hose on the hub during rewinding of the hose. A lock is provided on the hose guide to selectively connect the hose guide to the reel for rotation therewith. The hose reel is also provided with a brake which is connected between the hub and the horizontal portion of the upstanding tube. The brake includes a C-shaped member which may be selectively clamped into frictional engagement with the horizontal portion of the upstanding tube, the C-shaped member being attached to the hub to restrict rotation thereof when engaged on the upstanding tube.

DESCRIPTION OF THE PREFERRED EMBODIMENTS

Figure 1:
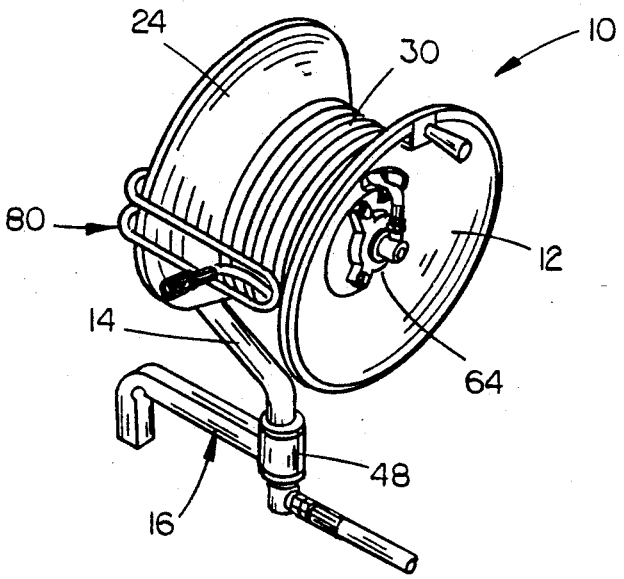
FIG. 1 is a perspective view of the present invention.

Referring now to the drawings, in which similar or corresponding parts are identified with the same reference numeral, and more particularly to FIG. 1, the hose reel of the present invention is designated generally at 10 and includes a reel 12 rotatably mounted on an upstanding tube 14 which is pivotally connected to a support arm 16 such that the reel 12 will pivot on a vertical axis extending to the connection of upstanding tube 14 with support arm 16 while permitting rotation of reel 12 on a horizontal axis on the upper end of upstanding tube 14.

Figure 3:
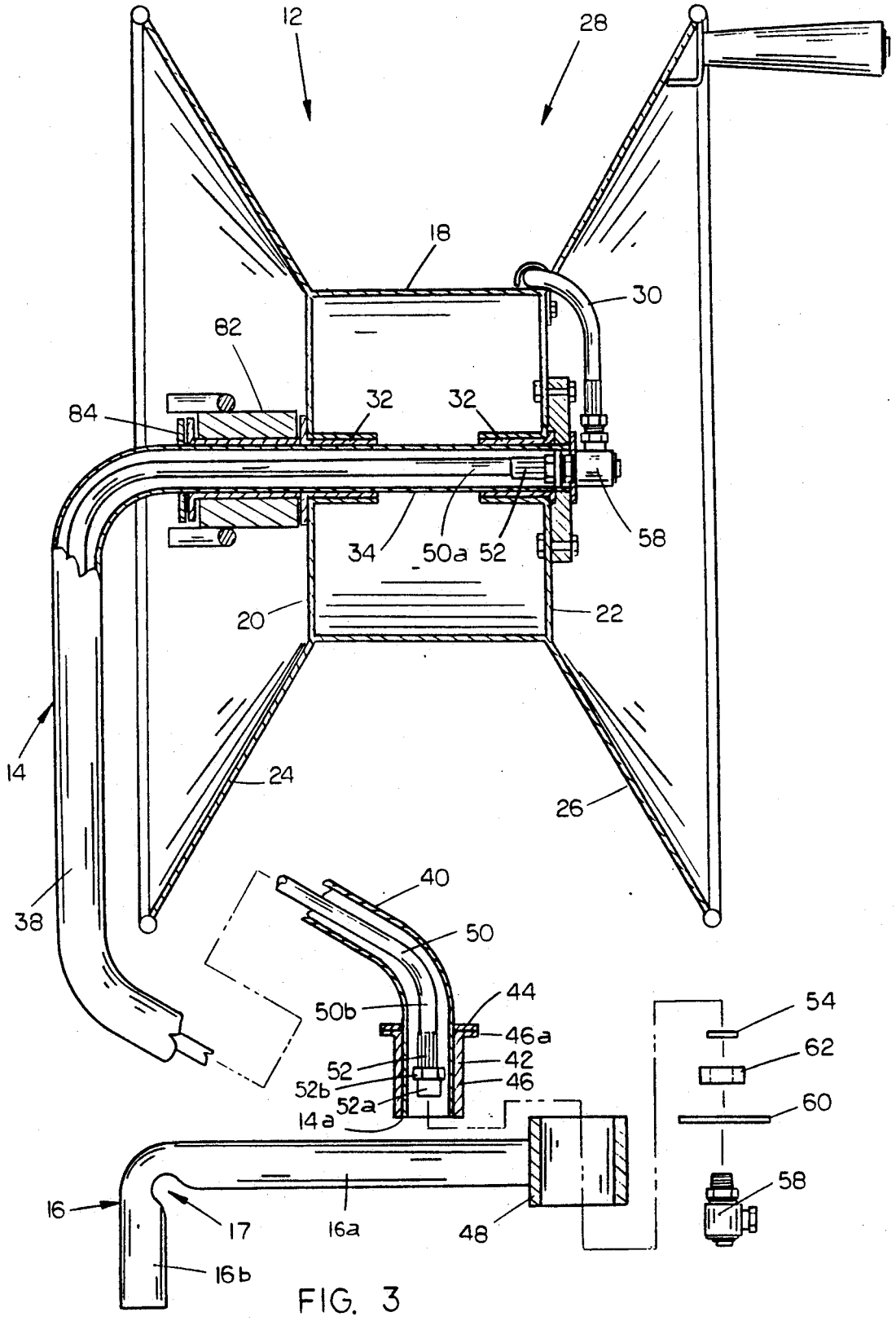
FIG. 3 is a partially exploded vertical sectional view through the hose reel.

Referring now to FIG. 3, reel 12 includes a generally cylindrical hub 18 with opposing circular side walls 20 and 22 respectively. For purposes of clarity, side wall 20 will be referred to as the "rearward wall" and side wall 22 will be referred to as front wall 22. A pair of annular flanges 24 and 26 project outwardly from front wall 22 and rearward wall 20 so as to form a generally V-shaped annular channel 28 into which hose (shown in FIG. 1) may be wound. Preferably, flanges 24 and 26 are set at an angle of approximately 30° from the vertical, so as to cause the hose to "track" or form uniform layers on the reel as it is rolled up. A pair of bearings are mounted in a pair of apertures in side walls 20 and 22 through which a horizontal section 34 of upstanding tube 14 is journaled. Bearings 32 permit reel 12 to rotate on horizontal section 34.

Upstanding tube 14 is bent vertically from the rearward end of horizontal section 34, with vertical section 38 extending the approximate radius of rearward annular flange 24. Tube 14 is then bent to form a downwardly extending diagonal section 40 which extends to a point generally centered below hub 18. A lower section 42 depends vertically from the lower end of diagonal section 40, as shown in the drawings. A flange 44 extends radially outwardly from lower section 42 spaced upwardly away from the lower end 14*a* of upstanding tube 14, and a generally cylindrical bearing 46 is mounted between flange 44 and end 14*a*. Bearing 46 will slide within a vertical sleeve 48 affixed to one end of support arm 16 so as to permit rotation of tube 14 within sleeve 48. A lip 46*a* on bearing 48 adjacent flange 44 will support the reel 12 and tube 14 on the upper end of sleeve 48.

Support arm 16 is preferably formed from a hollow tubular member bent into a generally L-shaped member having a horizontal leg 16*a* and a short vertical leg 16*b*, with sleeve 48 mounted on the end of horizontal leg 16*a*.

Figure 5:
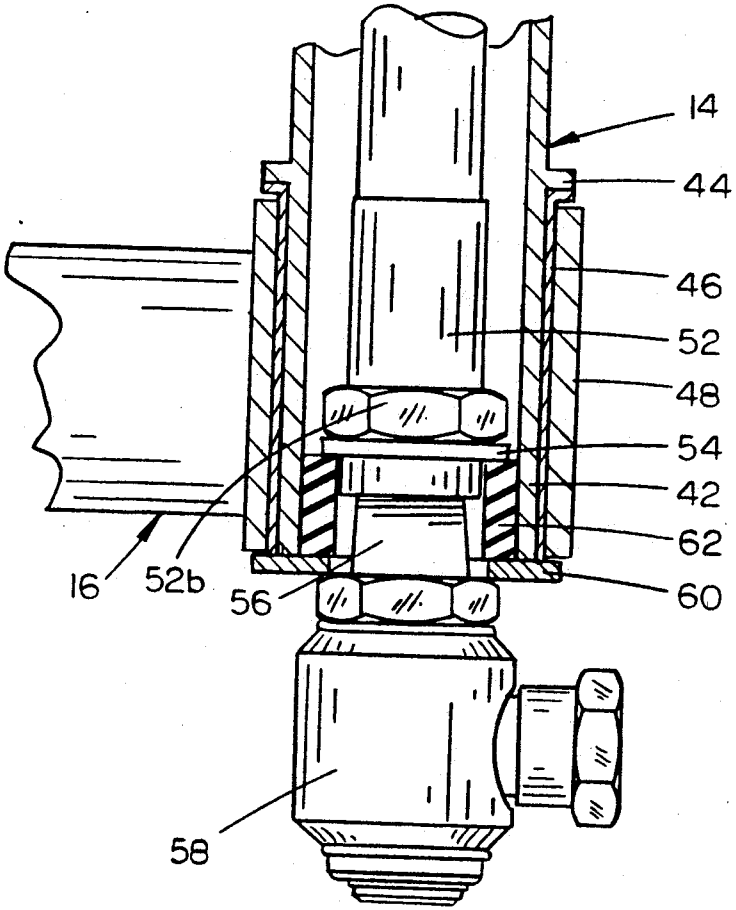
FIG. 5 is a view similar to FIG. 4 with the full connection made between the hose reel and support arm.
Figure 4:
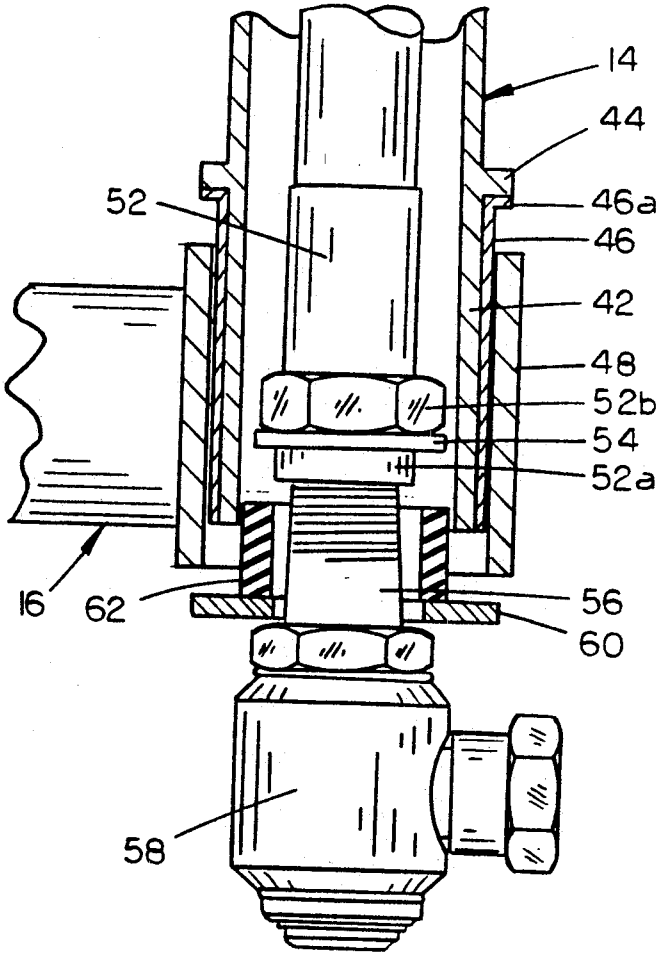
FIG. 4 is an enlarged sectional view through the pivotal connection of the hose reel to a support arm, as shown in FIG. 3.

A high pressure hose 50 extends through upstanding tube 14 and has an upper end 50*a* and a lower end 50*b*. Each end 50*a* and 50*b* is fitted with a connector 52 which has an interiorly threaded end 52*a* with a generally cylindrical bearing surface therearound, and a formed hexagonal portion 52*b* designed for rotation by a wrench. As shown in FIGS. 4 and 5, a washer 54 fits over the outside of the interiorly threaded portion 52*a*, against the formed hexagonal portion 52*b*. The exteriorly threaded end 56 of a conventional swivel valve 58 has an enlarged flat washer 60 journaled on the threaded end thereof. A resilient compression seal 62 is then journaled on threaded end 56 and swivel valve 58 is connected to connector 52 by threading threaded end 56 into the interiorly threaded portion 52*a* of connector 52. As shown in FIG. 5, compression seal 62 has a length, thickness and diameter such that connecting swivel valve 58 to connector 52 will squeeze compression seal 62 between washers 54 and 60, causing compression seal 62 to bulge outwardly into frictional engagement with the interior of vertical section 42 of upstanding tube 14, to form a tight seal.

Enlarged flat washer 60 has a diameter great enough to bear against the lower end of sleeve 48 to retain sleeve 48 between flange 44 and flat washer 60, for rotation on bearing 46.

Referring to FIG. 3, a similar swivel valve 58' is connected to upper end 50*a* of high pressure hose 50 so that reel 12 may rotate about horizontal section 34 of upstanding tube 14 without rotating hose 50. Upper swivel valve 58' is connected in the same fashion as lower swivel valve 58, using a washer 54', flat washer 60' and compression seal 62'.

Figure 8:
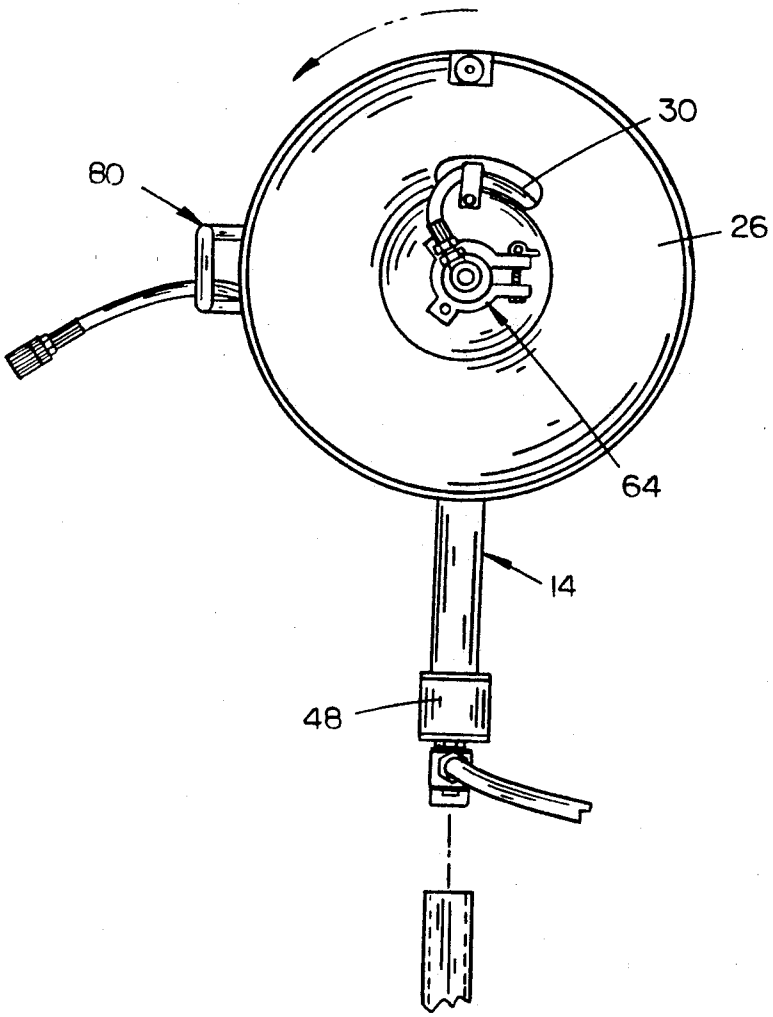
FIG. 8 is a side elevational view taken from the right side of FIG. 7.
Figure 7:
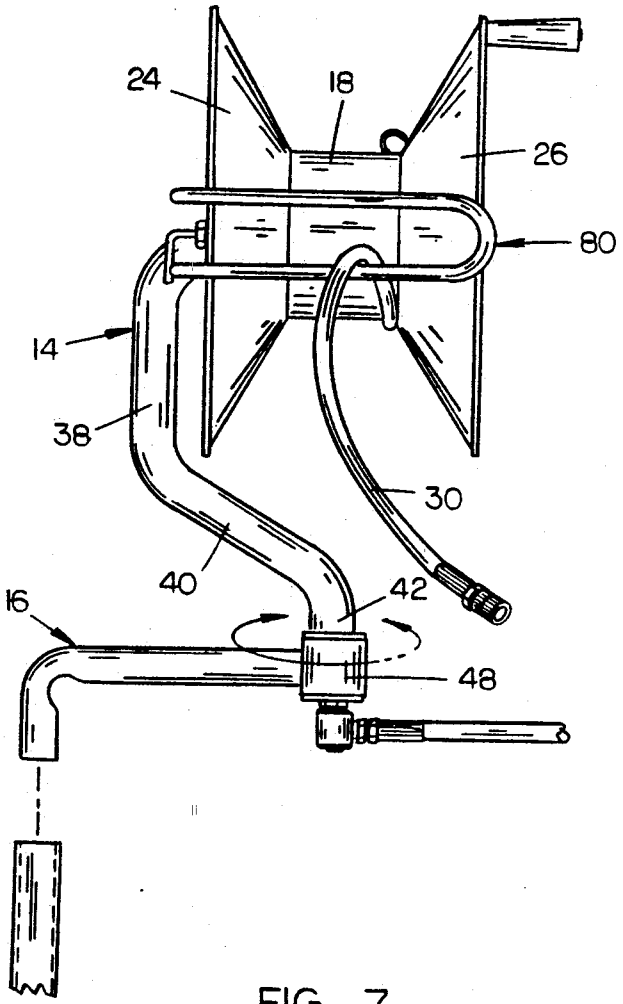
FIG. 7 is a front elevational view of the invention, similar to that of FIG. 3.
Figure 12:
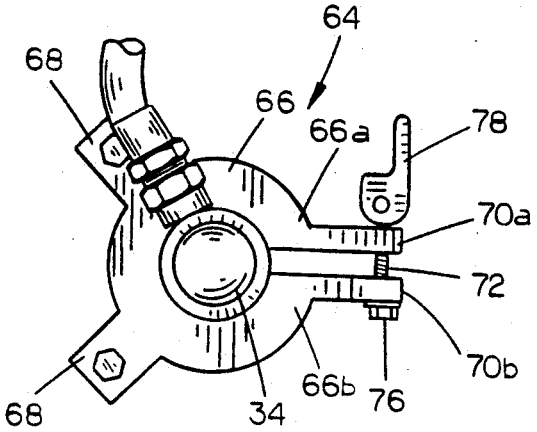
FIG. 12 is an enlarged elevational view of the hose reel brake in a free wheeling position.
Figure 13:
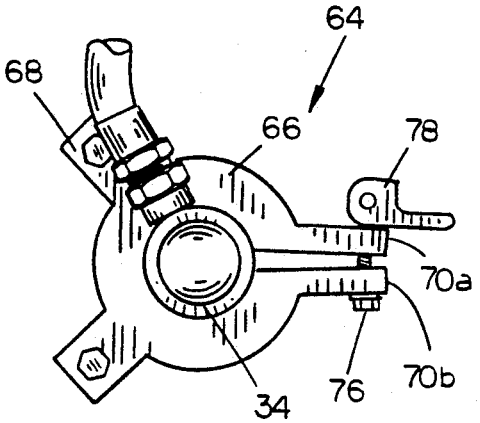
FIG. 13 is a view similar to FIG. 12 with the brake shown in the braking position.
Figure 14:
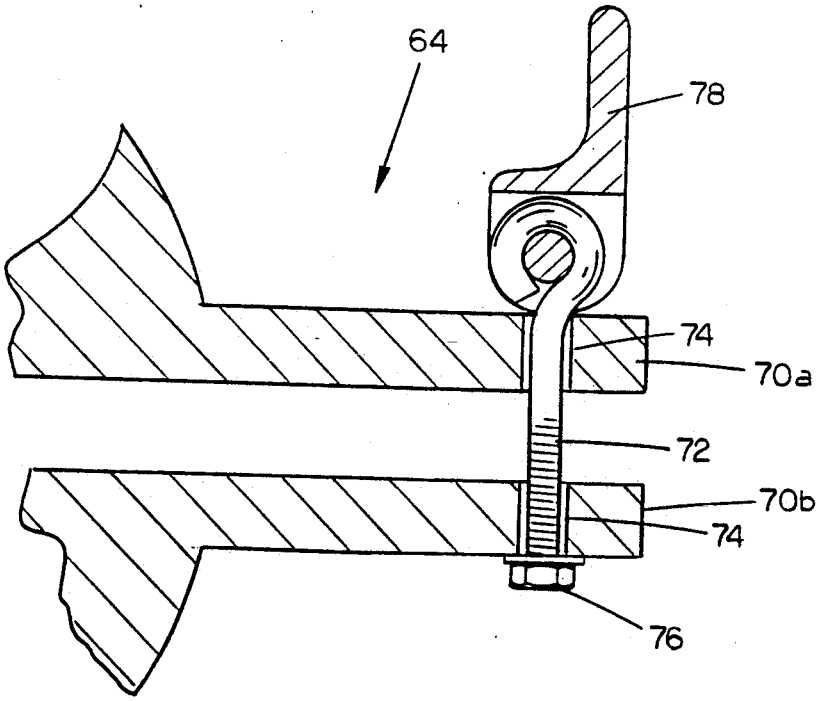
FIG. 14 is an enlarged sectional view through the cam lever of the brake of FIG. 11.

A brake apparatus is designated generally at 64 and is mounted on annular flange 26 in operable contact with the projecting end of the horizontal section 34 of upstanding tube 14. As shown in FIGS. 12 through 14, brake apparatus 64 includes a generally C-shaped member 66 having a pair of radially projecting ears 68, the ears being fastened to front wall 22 (as shown in FIG. 8). A pair of arms 70*a* and 70*b* project radially outwardly from the free ends 66*a* and 66*b* of C-shaped member 66. A bolt 72 extends through a pair of aligned apertures 74 in arms 70*a* and 70*b*, with an adjustable nut 76 on one end and an operable cam handle 78 on the other. Cam handle 78 is pivotal so as to force arms 70*a* and 70*b* towards one another when moved to a first position (as shown in FIG. 13), and to allow arms 70*a* and 70*b* to return to a generally parallel condition when cam handle 78 is moved to a second position (as shown in FIG. 12). This camming action will reduce the diameter of the interior of C-shaped member 66 so as to cause C-shaped member 66 to frictionally engage horizontal section 34 of upstanding tubular member 14, thereby restricting rotation of the reel on the upstanding tube.

Figure 2:
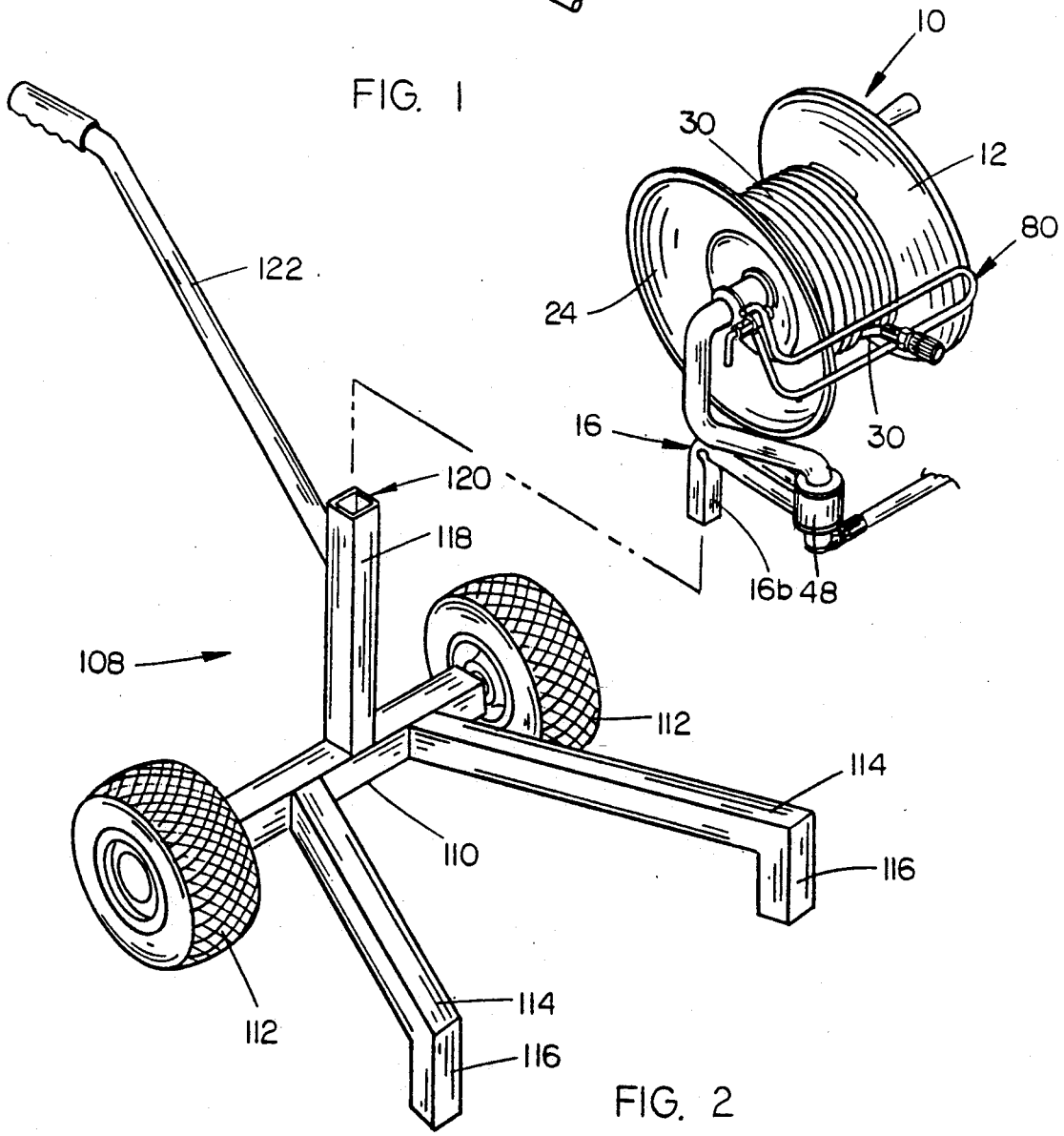
FIG. 2 is a perspective view of the invention ready for mounting on a special wheeled support.
Figures 9, 10, 11:
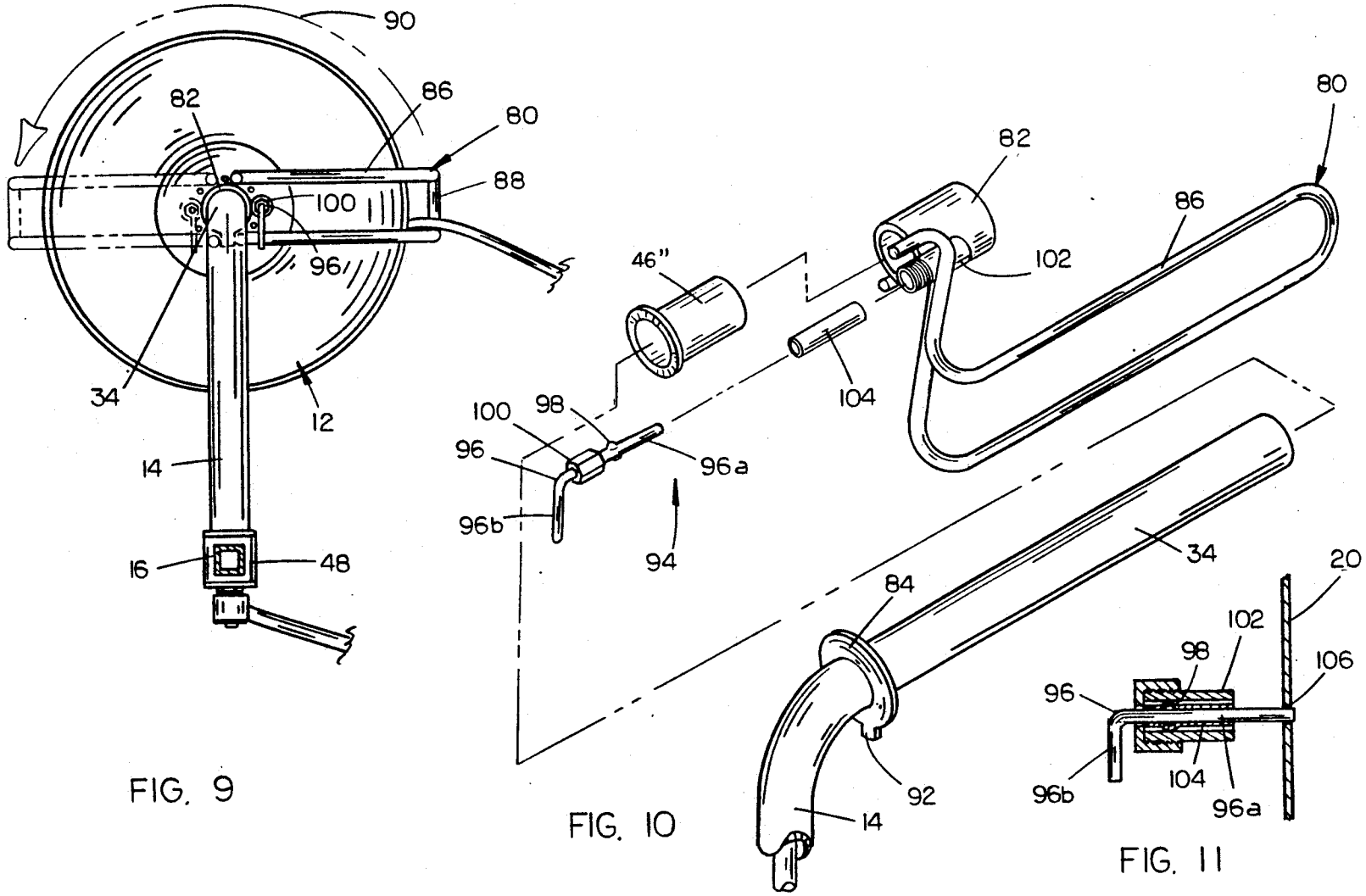
FIG. 9 is a side elevational view taken from the left side of FIG. 7.
FIG. 10 is an exploded perspective view of the hose guide of the invention.
FIG. 11 is an enlarged sectional view through the locking apparatus shown in FIG. 10.

As shown in FIGS. 1 and 2, hose reel 10 includes a hose guide apparatus 80 which will guide hose 30 from reel 12. FIGS. 9 and 10 more specifically show that hose guide 80 is pivotal on horizontal section 34 of upstanding tube 14. Hose guide apparatus 80 includes a sleeve 82 rotatably mounted on horizontal section 34 adjacent side wall 20 of reel 12. A flange 84 on horizontal section 34 will retain sleeve 82 on a cylindrical bearing 46" on horizontal section 34, as shown in FIGS. 3 and 10. A U-shaped rod 86 has its legs mounted on sleeve 82 and projects diagonally around annular flange 24 of reel 12, and is then bent parallel to horizontal section 34. In this way, the U-shaped guide portion 88 of rod 86 may be pivoted on sleeve 82 parallel to horizontal section 34, as shown by arrow 90 in FIG. 9. A tooth 92 projects from flange 84 (as shown in FIG. 10) and will prevent hose guide 80 from pivoting entirely around reel 12, as shown in FIG. 9.

A lock mechanism 94 is shown in exploded view in FIG. 10, and is utilized to lock hose guide 80 with reel 12. Lock apparatus 94 includes an L-shaped pin 96 having a pair of diametric protrusions 98 on the elongated leg 96*a* thereof. A cap 100 is interiorly threaded as an aperture in its top so as to be suitably mounted on elongated leg 96*a* between protrusions 98 and short leg 96*b* of pin 96. Cap 100 is designed to thread on a short tube 102 mounted on sleeve 82. A resilient hollow tubular member 104 fits within tube 102 and over pin 96. Protrusions 98 will expand the diameter of resilient tubular member 104 to frictionally contact the interior of tube 102 to frictionally maintain the position of pin 96, as shown in FIG. 11. In this way, pin 96 will slide longitudinally through tube 102 so as to project into one of a plurality of apertures 106 in side wall 20, as shown in FIG. 9. The frictional contact between resilient tube 104 within tube 102 will maintain pin 96 in the desired position.

Hose reel 10 can be utilized in many ways, and is therefore adapted for easy transportability as shown in FIG. 2, a two wheel cart 108 is designed for transport of hose reel 10. Cart 108 includes an axle 110 having a pair of wheels 112 rotatably mounted thereon. A pair of support legs 114 extend forwardly from axle 110 and have the pending feet 116 thereon for ground support. A vertical square tube 118 projects upwardly from axle 110. The depending end **16*b* of support arm 16 may be suitably mounted within the upper end 120 of vertical tube 118 to retain hose reel 10 on cart 108. A handle 122 projects rearwardly and upwardly from vertical tube 118 to permit ease of movement of the hose reel on cart 108**.

Figure 6:
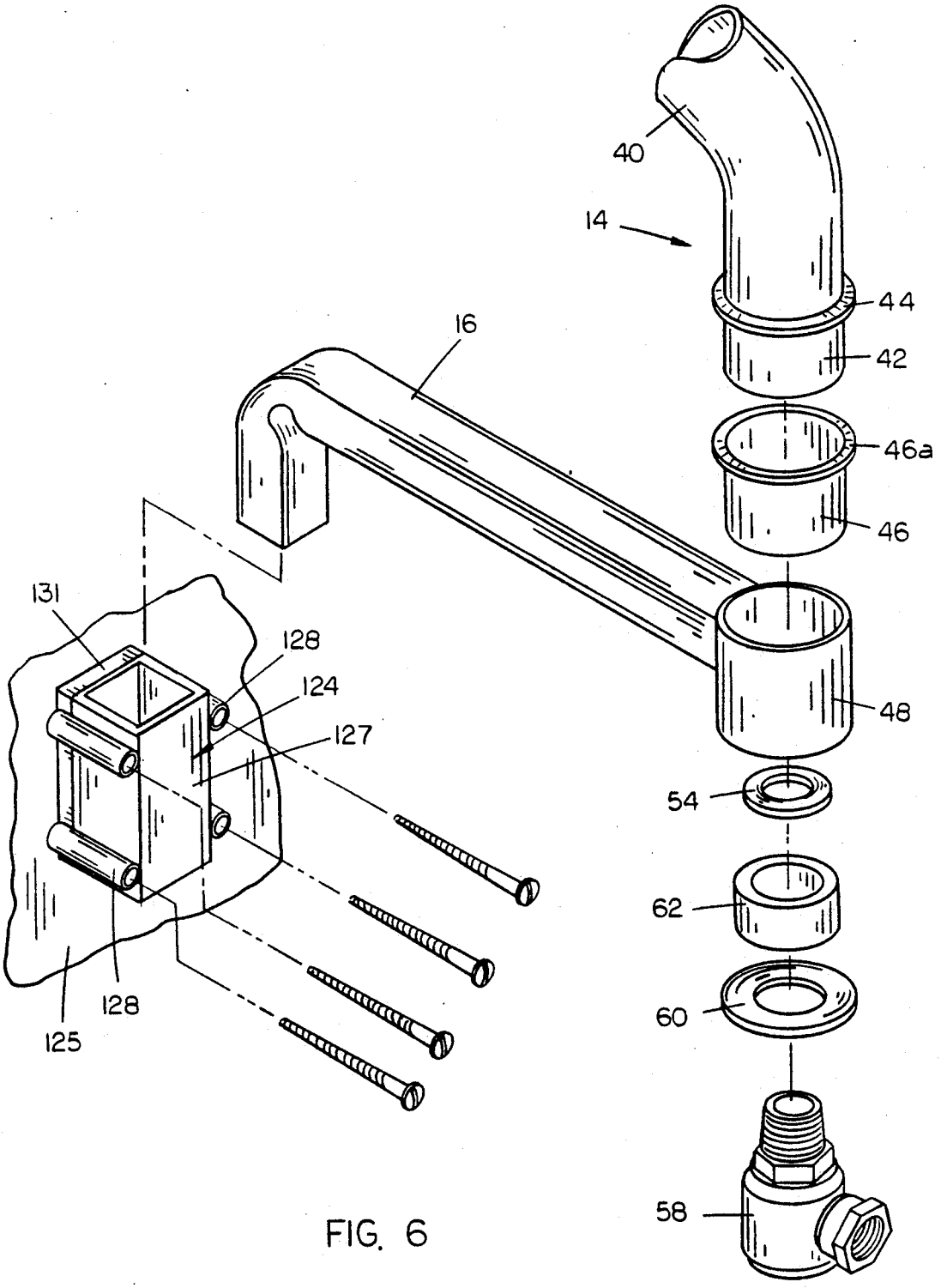
FIG. 6 is an exploded perspective view of the pivotal connection between the hose reel and the support arm.

Referring now to FIG. 6, support arm 16 includes a depending leg **16*a* formed by a crush-bend, designated at 17 in the drawings. A special bracket 124 may be mounted to a wall 125 (as in FIG. 6) or on a vertical pole 126 (as in FIG. 17). Bracket 124 includes a square, vertically-oriented tube 127 with four transverse sleeves 128 mounted thereon. Woodscrews 129 or the like are inserted through sleeves 128 to fasten tube 127 to wall 125. A support plate 131 is mounted to one side of tube 127 to increase strength and prevent crushing of the tube. Thus, hose reel 10 may be mounted on a wall or the like utilizing bracket 124**.

Figure 15:
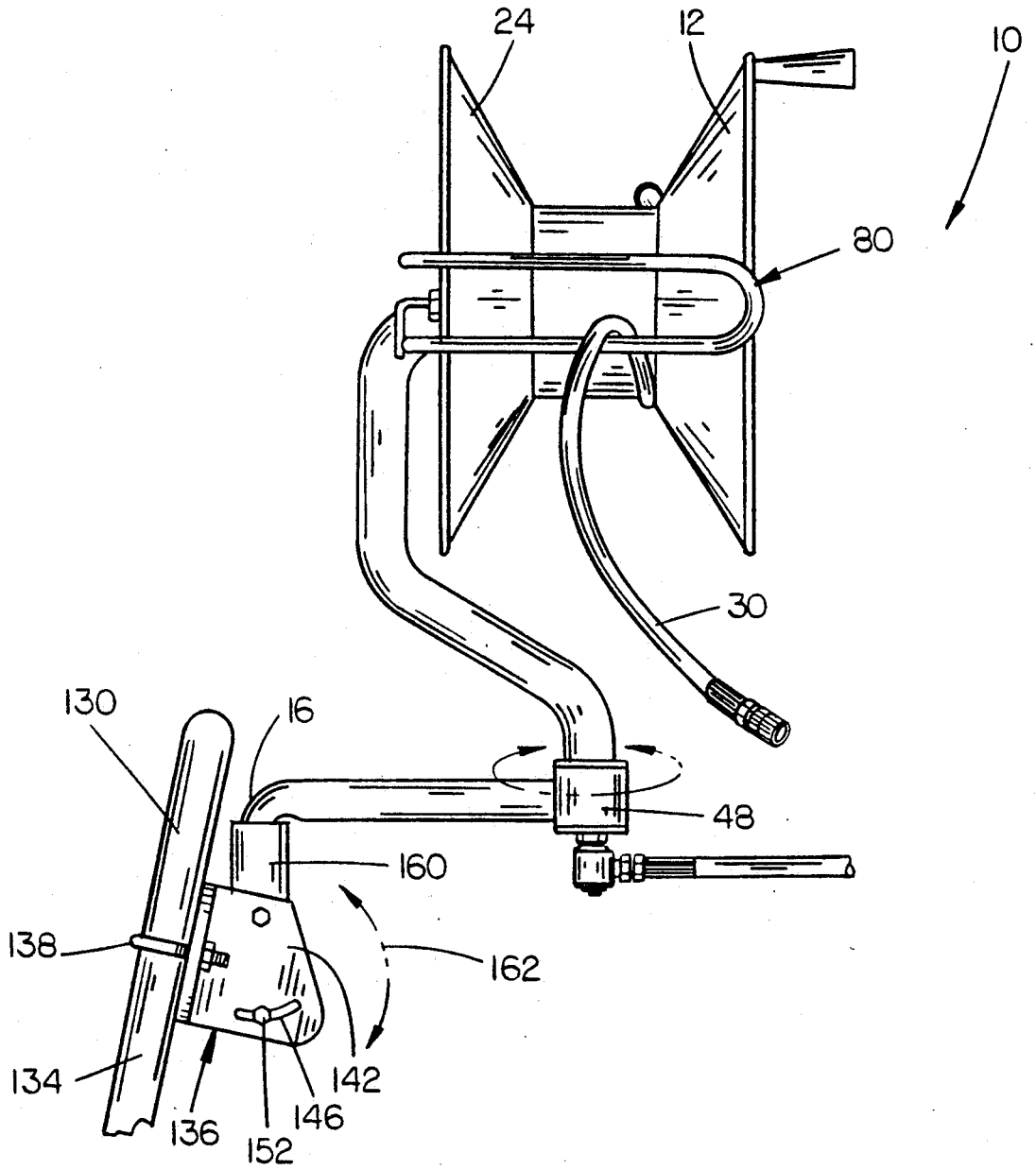
FIG. 15 is an elevational view of the hose reel mounted in a second embodiment of a support bracket.
Figure 16:
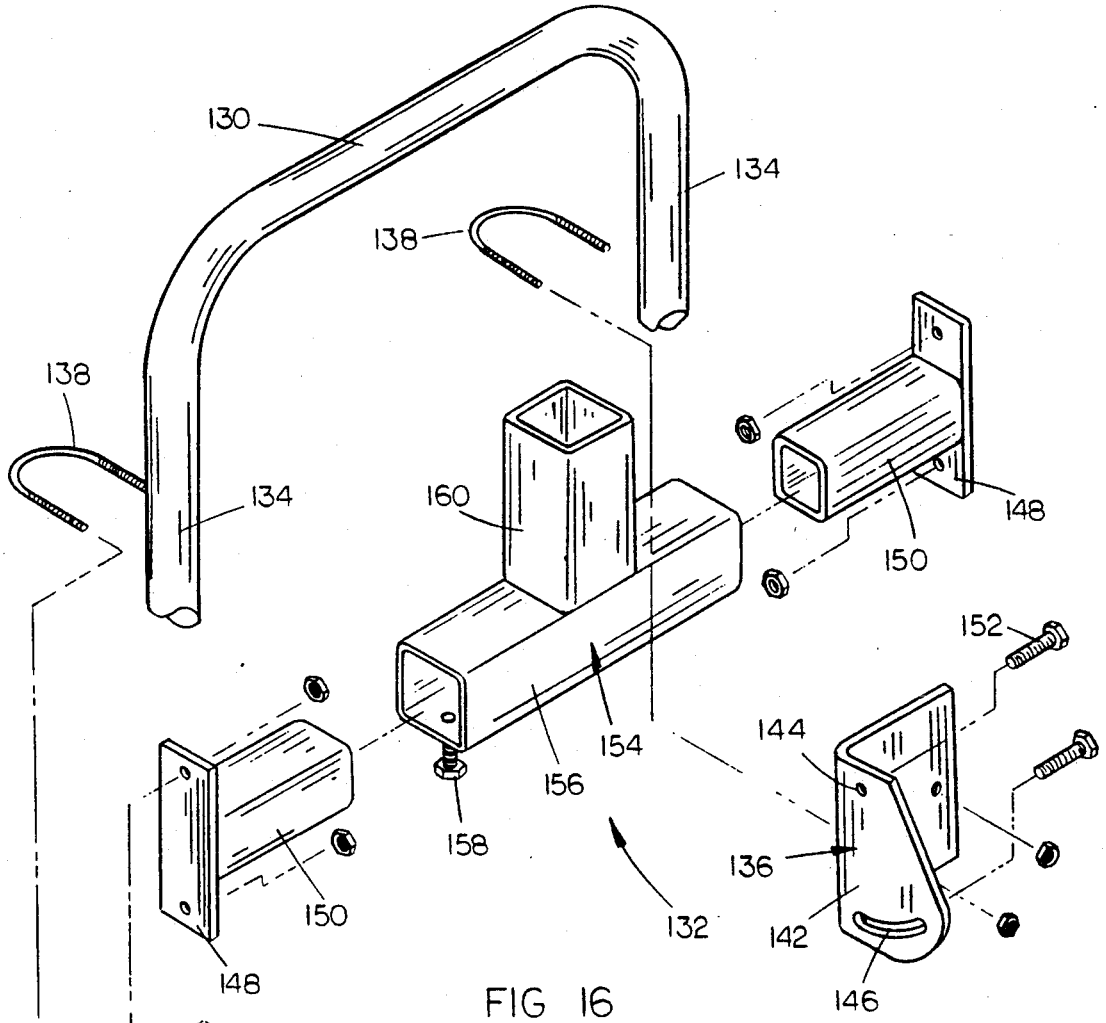
FIG. 16 is an exploded perspective view of the support bracket of FIG. 15.

Referring now to FIGS. 15 and 16, hose reel 10 may also be attached to the generally parallel legs of a handle 130 of a conventional high pressure washer cart. An adjustable bracket 132 is connected between the legs 134 of handle 130, and includes a pair of support members 136 connected to each 134 with a U-bolt 138. Support members 136 each include a base portion 140 through which U-bolt 138 is fastened, and a projecting portion 142, projecting generally perpendicular to base portion 140. In this fashion, projecting portions 142 of the two support members 136 will be parallel when fastened to legs 134.

Projecting portions 142 include an upper aperture 144 and a lower arcuate slot 146 to which the base plate 148 of a short length of tube 150 is attached via bolts 152. Short tubes 150 are coaxial and project towards one another and will receive a generally t-shaped hollow tubular member 154 (hereinafter "T-tube"). T-tube 154 has a horizontally extending elongated base tube 156 with dimensions to slide telescopically over tubes 150. A set screw 158 is journaled through base tube 156 and will engage one of short tubes 150 to maintain base tube 156 in the desired position on short tubes 150.

Upstanding tube 160 may be adjusted so as to be vertical regardless of the angle of handle 130, by loosening and tightening bolt 152 within slot 146 in projecting portions 142 of support members 136. Arrow 162 indicates the relative pivotal movement possible by upstanding tube 160. In addition, as shown in FIG. 15, tube 156 can be removed and turned at 90° increments with respect to short tubes 150, to provide a wide variety of different angles at which upstanding tube 160 may be set.

Thus, the combination of the arcuate slot with the capability of rotating tube 156 at 90° increments, permits upstanding tube 160 to be adjustable through a full 360° in a vertical plane.

Figure 17:
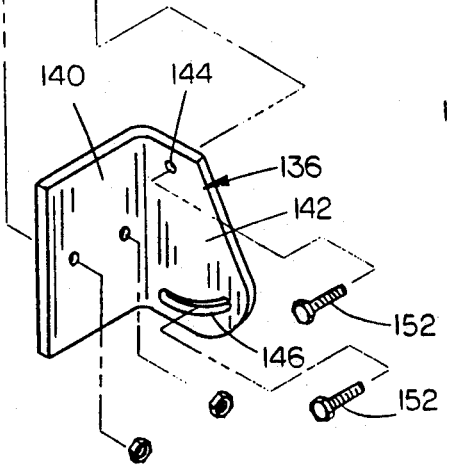
FIG. 17 is a perspective view of the support bracket shown in FIG. 6, as utilized on a vertical pole.
Figure 17:
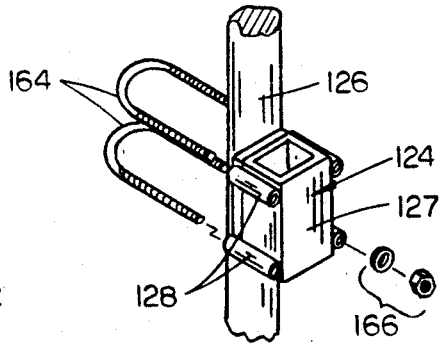

Referring now to FIG. 17, bracket 124 may also be utilized to mount the hose reel 10 (not shown) to a vertical pole 126. A pair of U-bolts 164 are journaled around pole 126 and through sleeves 128. A washer and nut combination 166 is threaded on each U-bolt leg, to affix bracket 124 in position.

Whereas the invention has been shown and described in connection with the preferred embodiments thereof, it will be understood that many modifications, substitutions and additions may be made which are within the intended broad scope of the appended claims. There has therefore been shown and described an improved hose reel which accomplishes at least all of the above stated objects.

I claim:

1. A hose reel, comprising:

a reel member rotatably mounted on a horizontal tube;

said reel member including a generally cylindrical hub portion coaxial with said horizontal tube, and a pair of opposing flanges projecting radially outwardly from said hub to form an annular channel for receiving a hose;

an upstanding tube depending from one end of said horizontal tube and bent so as to have a lower vertical portion aligned generally vertically under the center of said reel member;

the lower end of said upstanding tube being rotatably mounted to a first end of a generally horizontal support arm, with the rotational axis of said upstanding tube oriented vertically under the reel member;

said support arm having a short depending arm at a second end thereof adapted for receipt within a tubular support;

said support arm having a length between the first and second ends to permit full rotation of said reel member and upstanding tube on said axis; and a hose guide, including:

a generally U-shaped rod member having a pair of legs connected at a base;

said U-shaped member legs having their free ends bent around one annular flange of said reel and connected to a sleeve rotatably mounted on said horizontal tube, such that said U-shaped rod is rotatable about an axis coaxial with the rotational axis of the reel member.

2. The hose reel of claim 1, wherein said U-shaped rod member extends completely across said reel from flange to flange, for guiding a hose between the legs of the U-shaped rod onto said reel hub.

3. A hose reel, comprising:

a reel member rotatably mounted on a horizontal tube;

said reel member including a generally cylindrical hub portion coaxial with said horizontal tube, and a pair of opposing flanges projecting radially outwardly from said hub to form an annular channel for receiving a hose;

an upstanding tube depending from one end of said horizontal tube and bent so as to have a lower vertical portion aligned generally vertically under the center of said reel member;

a flexible hose journaled through said upstanding tube and thence through said horizontal tube, to provide fluid to a hose on said reel;

the lower end of said upstanding tube being rotatably mounted to a first end of a generally horizontal support arm, with the rotational axis of said upstanding tube oriented vertically under the reel member;

said support arm having a short depending arm at a second end thereof adapted for receipt within a tubular support;

said support arm having a length between the first and second ends to permit full rotation of said reel member and upstanding tube on said axis;

the rotatable connection of said upstanding tube to said support arm including:

the lower end of said upstanding tube projecting beyond said support arm;

said lower end of said flexible hose having a fitting thereon;

a swivel valve having an upwardly projecting port and a swivel port, said upwardly projecting port being removably connected to said lower hose fitting for fluid communication;

means on said lower fitting and said swivel valve for retaining a seal therebetween;

a flexible, compressible seal means interposed between said fitting and swivel valve on said projecting port of the swivel valve, of a size adapted to expand in diameter so as to frictionally engage the interior of said upstanding tube when the fitting and swivel valve are tightened together.

4. A hose reel, comprising:

a reel member rotatably mounted on a horizontal tube;

said reel member including a generally cylindrical hub portion coaxial with said horizontal tube, and a pair of opposing flanges projecting radially outwardly from said hub to form an annular channel for receiving a hose;

a flexible hose journaled through said upstanding tube and thence through said horizontal tube, to provide fluid to a hose on said reel, the upper end of said flexible hose having a fitting thereon;

a swivel valve having an outwardly projecting port and a swivel port, removably connected to said fitting at said outwardly projecting port for fluid communication;

means on said fitting and said swivel valve for retaining a seal therebetween;

a flexible, compressible seal means interposed between said fitting and swivel valve on said projecting port, of a size adapted to expand in diameter to frictionally engage the horizontal tube when the fitting and swivel valve are tightened;

an upstanding tube depending from one end of said horizontal tube and bent so as to have a lower vertical portion aligned generally vertically under the center of said reel member;

the lower end of said upstanding tube being rotatably mounted to a first end of a generally horizontal support arm, with the rotational axis of said upstanding tube oriented vertically under the reel member;

said support arm having a short depending arm at a second end thereof adapted for receipt within a tubular support;

said support arm having a length between the first and second ends to permit full rotation of said reel member and upstanding tube on said axis.

5. A hose reel, comprising:

a reel member rotatably mounted on a horizontal tube;

said reel member including a generally cylindrical hub portion coaxial with said horizontal tube, and a pair of opposing flanges projecting radially outwardly from said hub to form an annular channel for receiving a hose;

an upstanding tube depending from one end of said horizontal tube and bent so as to have a lower vertical portion aligned generally vertically under the center of said reel member;

the lower end of said upstanding tube being rotatably mounted to a first end of a generally horizontal support arm, with the rotational axis of said upstanding tube oriented vertically under the reel member;

said support arm having a short depending arm at a second end thereof adapted for receipt within a tubular support;

said support arm having a length between the first and second ends to permit full rotation of said reel member and upstanding tube on said axis;

a hose guide, including:

a generally U-shaped rod member having a pair of legs connected at a base;

said U-shaped member legs having their free ends bent around one annular flange of said reel and connected to a sleeve rotatably mounted on said horizontal tube, such that said U-shaped rod is rotatable about an axis coaxial with the rotational axis of the reel member; and means on said horizontal tube for stopping the rotation of the hose guide sleeve beyond a predetermined position in each rotational direction of the sleeve.

6. A hose reel, comprising:

a reel member rotatably mounted on a horizontal tube;

said reel member including a generally cylindrical hub portion coaxial with said horizontal tube, and a pair of opposing flanges projecting radially outwardly from said hub to form an annular channel for receiving a hose;

an upstanding tube depending from one end of said horizontal tube and bent so as to have a lower vertical portion aligned generally vertically under the center of said reel member;

the lower end of said upstanding tube being rotatably mounted to a first end of a generally horizontal support arm, with the rotational axis of said upstanding tube oriented vertically under the reel member;

said support arm having a short depending arm at a second end thereof adapted for receipt within a tubular support;

said support arm having a length between the first and second ends to permit full rotation of said reel member and upstanding tube on said axis;

a hose guide, including:

a generally U-shaped rod member having a pair of legs connected at a base;

said U-shaped member legs having their free ends bent around one annular flange of said reel and connected to a sleeve rotatably mounted on said horizontal tube, such that said U-shaped rod is rotatable about an axis coaxial with the rotational axis of the reel member; and lock means for selectively locking said hose guide to said reel member for rotation therewith.

7. The hose reel of claim 7, wherein said reel member has front and rear sidewalls through which said horizontal tube passes, and wherein said lock means include:

a hollow tube attached to said hose guide sleeve and parallel thereto;

a pin slidably mounted through said tube and operable between a locked position, slid inwardly into journaled engagement with an aperture in the front sidewall of said reel member, and an unlocked position disengaged from said sidewall aperture.

8. The hose reel of claim 7, wherein said lock means further includes:

a resilient compressible tube member interposed between said hollow tube and coaxial therewith;

at least one protrusion on said pin protruding a distance to compress a portion of said resilient tube against the interior of said hollow tube to frictionally engage the pin and hollow tube to resist slidable movement of the pin.

9. A hose reel, comprising:

a reel member rotatably mounted on a horizontal tube;

said reel member including a generally cylindrical hub portion coaxial with said horizontal tube, and a pair of opposing flanges projecting radially outwardly from said hub to form an annular channel for receiving a hose;

said reel member having front and rear side walls through which said horizontal tube passes;

brake means for selectively restricting the rotation of said reel member on said horizontal tube, including:

said horizontal tube having one end projecting beyond the rear sidewall of said reel member;

a generally C-shaped member having a brake surface formed to engage at least one-half of the circumference of a portion of the projecting end of said horizontal tube;

a pair of ears projecting outwardly from said C-shaped member and generally parallel and spaced apart; and means for selectively squeezing said ears together so as to engage the brake surface of the C-shaped member with the circumference of the projecting end of the horizontal tube;

an upstanding tube depending from one end of said horizontal tube and bent so as to have a lower vertical portion aligned generally vertically under the center of said reel member;

the lower end of said upstanding tube being rotatably mounted to a first end of a generally horizontal support arm, with the rotational axis of said upstanding tube oriented vertically under the reel member;

said support arm having a short depending arm at a second end thereof adapted for receipt within a tubular support;

said support arm having a length between the first and second ends to permit full rotation of said reel member and upstanding tube on said axis.

10. The hose reel of claim 9, wherein said means for selectively squeezing said ears comprises:

bolt means projecting through coaxial apertures in said ears;

a nut connected to one end of said bolt; and a cam level operably connected to the opposite end of the bolt, operable to selectively push one ear towards the other ear.

11. A hose reel, comprising:

a reel member rotatably mounted on a horizontal tube;

said reel member including a generally cylindrical hub portion coaxial with said horizontal tube, and a pair of opposing flanges projecting radially outwardly from said hub to form an annular channel for receiving a hose;

an upstanding tube depending from one end of said horizontal tube and bent so as to have a lower vertical portion aligned generally vertically under the center of said reel member;

the lower end of said upstanding tube being rotatably mounted to a first end of a generally horizontal support arm, with the rotational axis of said upstanding tube oriented vertically under the reel member;

said support arm having a short depending arm at a second end thereof adapted for receipt within a tubular support;

said support arm having a length between the first and second ends to permit full rotation of said reel member and upstanding tube on said axis;

a tubular bracket for supporting said hose reel, comprising:

a generally vertically oriented tubular member having interior dimensions slightly greater than the exterior dimensions of the short depending arm of said support arm, to slidably receive said short arm therein;

a first pair of vertically spaced apart sleeves, oriented parallel and horizontally and affixed to one side of said tubular member;

a second pair of vertically spaced apart sleeves, oriented parallel and horizontally and affixed diametric to said first pair of sleeves and parallel thereto.

12. The hose reel of claim 11, wherein said tubular member is rectangular in cross-section and wherein said short arm is rectangular in cross-section.

13. The hose reel of claim 12, further comprising a support plate affixed flush to one side of said tubular member, perpendicular to said first and second pairs of sleeves, to strengthen said tubular member.

14. A hose reel, comprising:

a reel member rotatably mounted on a horizontal tube;

said reel member including a generally cylindrical hub portion coaxial with said horizontal tube, and a pair of opposing flanges projecting radially outwardly from said hub to form an annular channel for receiving a hose;

an upstanding tube depending from one end of said horizontal tube and bent so as to have a lower vertical portion aligned generally vertically under the center of said reel member;

the lower end of said upstanding tube being rotatably mounted to a first end of a generally horizontal support arm, with the rotational axis of said upstanding tube oriented vertically under the reel member;

said support arm having a short depending arm at a second end thereof adapted for receipt within a tubular support;

said support arm having a length between the first and second ends to permit full rotation of said reel member and upstanding tube on said axis;

a tubular support bracket for supporting said hose reel between a pair of spaced apart and parallel legs of a cart handle, comprising:

a generally vertically oriented tubular member having a rectangular cross-section and having interior dimensions slightly greater than the exterior dimensions of the short depending arm of said support arm, to slidably receive said short arm therein;

said vertical tube member being mounted on an elongated horizontal tubular member and perpendicular thereto, said elongated horizontal tubular member having first and second ends;

a first connecting bracket selectively connecting one leg of the handle to the first end of said elongated horizontal members; and a second connecting bracket selectively connecting the other leg of the two said second end of the elongated horizontal tubular member.

15. The hose reel of claim 14 wherein said first and second connecting brackets are selectively adjustable to permit adjustment of the orientation of said vertical tube about the longitudinal axis of the elongated horizontal tubular member.

16. A hose reel, comprising:

a reel member rotatably mounted on a horizontal tube;

said reel member including a generally cylindrical hub portion coaxial with said horizontal tube, and a pair of opposing flanges projecting radially outwardly from said hub to form an annular channel for receiving a hose;

an upstanding tube depending from one end of said horizontal tube and bent so as to have a lower vertical portion aligned generally vertically under the center of said reel member;

the lower end of said upstanding tube being rotatably mounted to a first end of a generally horizontal support arm, with the rotational axis of said upstanding tube oriented vertically under the reel member;

said support arm having a short depending arm at a second end thereof adapted for receipt within a tubular support;

said support arm having a length between the first and second ends to permit full rotation of said reel member and upstanding tube on said axis; and a tubular support for supporting said hose reel, including:

a vertically oriented tubular member having a rectangular cross-section and having interior dimensions slightly greater than the exterior dimensions of the short depending arm of said support arm, to slidably receive said short arm therein;

said vertical tube being mounted on a elongated axle and perpendicular thereto;

wheels rotatably mounted on said axle;

at least one support leg projecting horizontally from said axle with a foot portion adapted for ground engagement; and a handle projecting from said vertical tube for moving said tubular support on said wheels.

17. A hose reel, comprising:

a reel member rotatably mounted on a horizontal tube;

said reel member including a generally cylindrical hub portion coaxial with said horizontal tube, and a pair of opposing flanges projecting radially outwardly from said hub to form an annular channel for receiving a hose;

an upstanding tube depending from one end of said horizontal tube and bent so as to have a lower vertical portion aligned generally vertically under the center of said reel member;

a flexible high-pressure hose journaled through said upstanding tube and thence through said horizontal tube, to provide high-pressure fluid to a hose on said reel;

the lower end of said upstanding tube being rotatably mounted to a first end of a generally horizontal support arm, with the rotational axis of said upstanding tube oriented vertically under the reel member;

said support arm having a short depending arm at a second end thereof adapted for receipt within a tubular support;

said support arm having a length between the first and second ends to permit full rotation of said reel member and upstanding tube on said axis;

said rotatable connection of said upstanding tube to said support arm including:

the lower end of said upstanding tube projecting beyond said support arm;

said lower end of said flexible hose having a fitting thereon;

a swivel valve having an upwardly projecting port and a swivel port, said upwardly projecting port being removably connected to said lower hose fitting for fluid communication;

means on said lower fitting and said swivel valve for retaining a seal therebetween; and a removable seal means interposed between said fitting and swivel valve on said projecting port of the swivel valve, removably mounted in the lower end of said upstanding tube for rotation therewith.

* * * * *